US007470135B2

(12) United States Patent
Perrin et al.

(10) Patent No.: US 7,470,135 B2
(45) Date of Patent: Dec. 30, 2008

(54) SYSTEM FOR AUTOMATICALLY CONNECTING TWO ELECTRIC CIRCUITS OF A VEHICLE

(75) Inventors: Philippe Perrin, Le Perray En Yvelines (FR); Joël Lacrouts-Cazenave, Maurepas (FR)

(73) Assignee: Societe Compagnie Deutsch, Rueil-Malmaison (FR)

( * ) Notice: Subject to any disclaimer, the term of this patent is extended or adjusted under 35 U.S.C. 154(b) by 0 days.

(21) Appl. No.: 11/629,674

(22) PCT Filed: Jun. 17, 2005

(86) PCT No.: PCT/FR2005/001517

§ 371 (c)(1),
(2), (4) Date: Mar. 26, 2007

(87) PCT Pub. No.: WO2006/008374

PCT Pub. Date: Jan. 26, 2006

(65) Prior Publication Data

US 2007/0259550 A1 Nov. 8, 2007

(30) Foreign Application Priority Data

Jun. 18, 2004 (FR) ..... 04 06655

(51) Int. Cl.
*H01R 13/74* (2006.01)

(52) U.S. Cl. ..... 439/247; 439/378; 439/188; 439/374

(58) Field of Classification Search ..... 439/247, 439/374, 378, 188, 248
See application file for complete search history.

(56) References Cited

U.S. PATENT DOCUMENTS

| | | | | |
|---|---|---|---|---|
| 5,803,758 | A | 9/1998 | Kameyama | |
| 6,565,390 | B2 * | 5/2003 | Wu | 439/680 |
| 6,652,304 | B1 | 11/2003 | Chalons et al. | |
| 6,835,079 | B2 * | 12/2004 | Gentry et al. | 439/188 |
| 7,179,113 | B2 * | 2/2007 | Koenig et al. | 439/374 |
| 2003/0036302 | A1 * | 2/2003 | Fukuda | 439/374 |
| 2003/0109167 | A1 * | 6/2003 | Maegawa | 439/374 |

FOREIGN PATENT DOCUMENTS

| | | |
|---|---|---|
| EP | 0 753 905 | 1/1997 |
| EP | 1 135 833 | 6/2000 |

* cited by examiner

*Primary Examiner*—Gary F. Paumen
(74) *Attorney, Agent, or Firm*—Young & Thompson

(57) ABSTRACT

The inventive system for automatically connecting the main electric circuit of a vehicle to the auxiliary circuit of a subset like a seat comprises an auxiliary contact carrier (5) fixed to said subset and a main contact carrier (4) which is movable along a structural element. Said main contact carrier (4) is oscillatingly mounted on the support (1) of a structural element in such a way that it is supported by a spring (6) and is provided with protruding members for guiding the auxiliary contact carrier (5) during a connecting movement.

9 Claims, 6 Drawing Sheets

SYSTEM FOR AUTOMATICALLY CONNECTING TWO ELECTRIC CIRCUITS OF A VEHICLE

TITLE OF THE INVENTION

1. Background of the Invention

The invention relates to a system of automatic connection of two electrical circuits of a vehicle, and more precisely a system for automatic connection of a principal electric circuit of the vehicle to an auxiliary electrical circuit of a sub-assembly, such as a seat, of the vehicle.

2. Description of the Related Art

U.S. Pat. No. 5,752,845 describes an arrangement in which the sub-assembly is mounted on a structural element of the vehicle in a substantially vertical mounting direction, an auxiliary element of the electrical connector, fixed on the sub-assembly, being coupled to a principal electrical connector element carried by the principal electrical element carried by the structural element. The principal electrical connector element is movable relative to the structural element, between a rest position toward which it is resiliently urged, and a connection position toward which it is moved automatically by the sub-assembly.

EP 1 135 833 describes an arrangement of the same type in which the principal electrical connector element is swingably mounted relative to the structural element of the vehicle, about a horizontal swinging axis, the auxiliary electrical connector element carrying a control tongue to swing the principal connector element from its rest position toward its connection position.

Because the principal electrical connector element is swingably mounted about a horizontal swinging axis, it is necessary, in order to ensure the taking up of the play at the time of connection, to use an intermediate guided plate, urged by several springs acting in different directions. The principal connector element is mounted on this intermediate plate and is urged toward its rest position by another spring.

The arrangement thus described is complicated, it comprises a high number of pieces to be assembled and several springs; it is accordingly sensitive to assemble and to use.

SUMMARY OF THE INVENTION

An object of the present invention is to avoid the complexity of the known arrangements and to propose a connection system that is simple and easy to use, whilst being reliable.

Another object of the present invention is to propose a connection system without interaction with the support structure of the connection.

The invention has for its object an automatic connection system of a principal electrical circuit of a vehicle to an auxiliary electrical circuit of a sub-assembly such as a seat of the vehicle, movable for its securement to a structural element of the vehicle in a substantially vertical mounting direction, said system comprising an auxiliary contact carrier, fixed on the sub-assembly, and a principal contact carrier movable on the structural element, between a rest position toward which it is resiliently urged and a connection position toward which it is automatically moved by the auxiliary contact carrier during mounting of the sub-assembly on the structural element of the vehicle, the connection between the principal contact carrier and the auxiliary contact carrier being ensured in a substantially vertical plane, characterized in that: the principal contact carrier is swingably mounted in a support of the structural element, bearing on a spring, and comprises projecting members to ensure the guidance of the auxiliary contact carrier during the connection movement.

According to other characteristics:

- the projecting members comprise protuberances disposed on the lateral surfaces of the principal contact carrier and adapted to guide the lateral surfaces of the auxiliary contact carrier;
- the protuberances have a rear profile adapted to coact with a ramp carried by the auxiliary contact carrier;
- the principal contact carrier has on its front surface a lower lip adapted to coact with the lower portion of the auxiliary contact carrier;
- the principal contact carrier has on its front surface an upper lip adapted to coact with a ridge of the auxiliary contact carrier;
- the principal contact carrier has an actuating finger for an actuator carried by the auxiliary contact carrier to ensure the deshunting of the auxiliary contacts at the end of connection;
- the spring has one end fixed to the support, its other end being free, and it is bent in a curve below the principal contact carrier.

According to a particular embodiment of the invention, said principal contact carrier and said auxiliary contact carrier each comprise a protection means covering their respective contact elements, each of said protection means comprising a conductive portion, each of said protection means being movable between an inactive position in which said conductive portion is not in contact with said corresponding contact element and an active position in which said conductive portion is in contact with said corresponding contact elements, said protection means being adapted to assume automatically said active position when said principal contact carrier is moved to said connection position, said conductive portions of each of said protection means being in contact when said protection means are in said active position.

Preferably, each of said protection means comprises a flexible membrane, said membrane being fixed in a sealed relation to a flange surrounding said contact elements, said conductive portion comprising metallic lugs passing through said membrane.

BRIEF DESCRIPTION OF THE DRAWINGS

Other characteristics will become apparent from the description which follows given with reference to the accompanying drawings, in which.

DESCRIPTION OF THE PREFERRED EMBODIMENT

Figure 1:
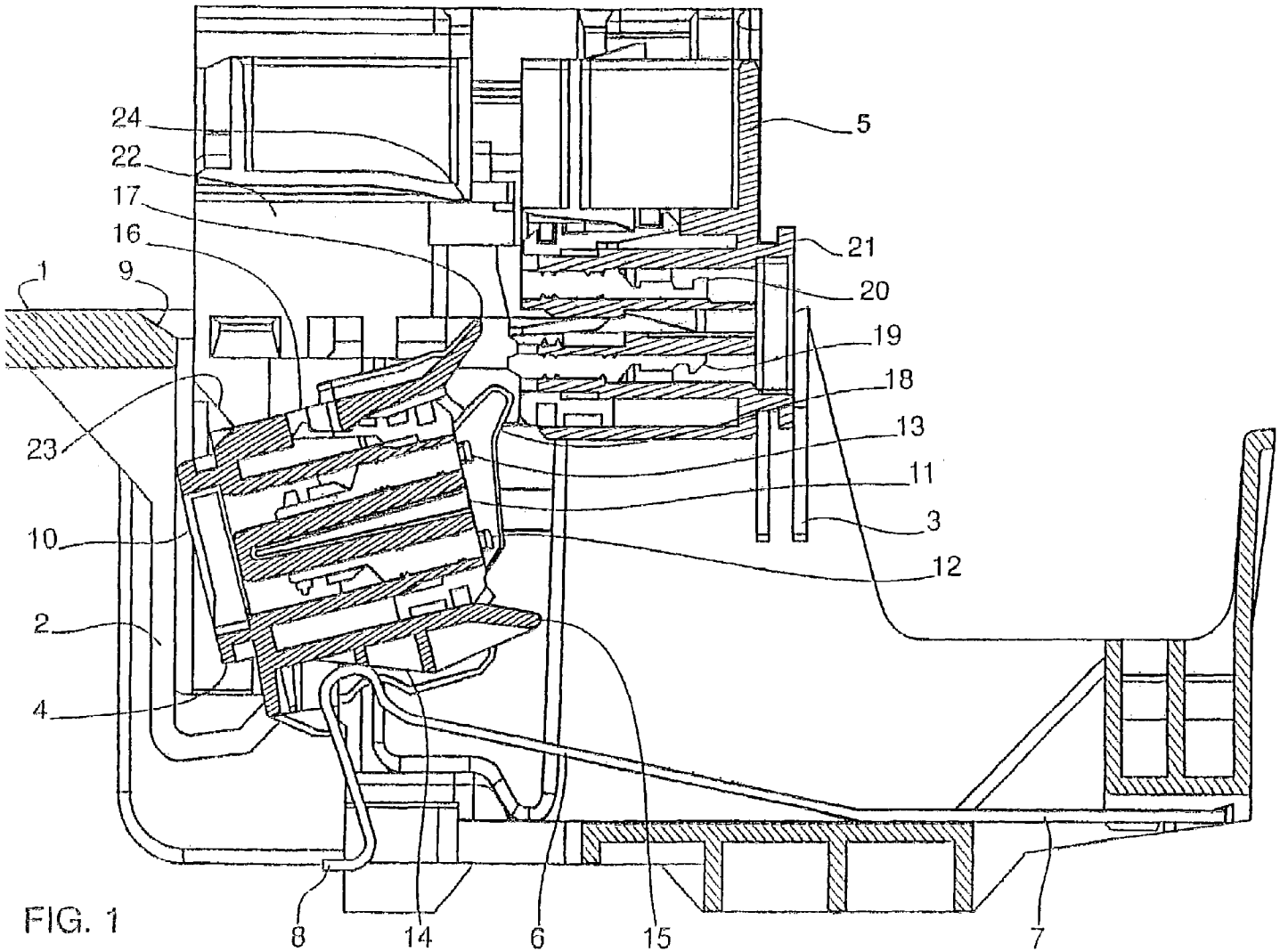
FIG. 1 is a fragmentary axial cross-sectional view of the automatic connection system according to one embodiment of the invention, at the beginning of the descending movement of the auxiliary contact carrier.

In FIG. 1, a support 1 secured to the floor of the vehicle constitutes a sort of housing open at its upper portion, having a rear partition and a front partition 3 between which will move on the one hand the principal contact carrier 4, on the other hand the auxiliary contact carrier 5.

The support 1 comprises two lateral partitions, parallel to the plane of the sheet, each having a vertical slideway upwardly open like a funnel, adapted to receive, freely slidably, a finger carried laterally by the principal contact carrier 4, substantially at its base and forwardly. The principal contact carrier is thus guided during its insertion into the support 1.

At the bottom of the support 1 is disposed a spring 6 in the form of a blade, whose forward end 7 is rigidly fixed to the front of the base of the support 1. The blade is bent upwardly to be offset from the bottom of the support 1, then bent in a rounded shape toward the base below the principal contact carrier and its other end 8 or rear end is free and elbowed below the base of the support 1, by passing through an opening of the base of the support 1 through which it can pass in the case of pressure on its rounded portion.

On their upper edge, the partitions of the support 1 have chamfers such as 9 to guide the principal contact carrier 4 during its emplacement in the support 1, and the auxiliary contact carrier 5 during its descending movement.

The principal contact carrier 4 is in the general shape of a rectangular parallelepipedal. Its rear surface 10 is, in the rest position, bearing against the rear partition 2 of the support 1. This forward surface 11 lets pass the electrical contacts distributed in a lower row 12 and an upper row 13 in the illustrated embodiment, without the number of these rows being limiting. The lower surface 14 of the principal contact carrier 4 is prolonged forwardly by a lower oblique lip 15.

The upper surface 16 of the principal contact carrier 4 is prolonged forwardly by an upper oblique lip 17. The lips 15 and 17 diverge. The lateral surfaces of the principal contact carrier 4 bear protuberances such as 18 having forwardly a profile in the form of a horn directed upwardly.

In a manner known per se, the electrical contacts of the two rows 12 and 13 are connected at their rearward portion to a cable which is part of the electrical circuit of the vehicle and is not shown.

The auxiliary contact carrier 5 is in the form of a block having a forward portion and a rear portion. The forward portion comprises at its lower portion two rows of contacts adapted to be placed against the contacts of the principal contact carrier, and distributed respectively in a lower row 19 and an upper row 20. These two rows of contacts are disposed in a parallepipedal volume corresponding substantially to the volume of the principal contact carrier 4.

The forward surface 21 of the auxiliary contact carrier 5 is adapted to bear on the forward partition 3 of the support 1. The rear portion of the auxiliary contact carrier 5 has lateral walls such as 22 of which the lower edge is provided at the rear with a chamfer 23 adapted to coact with the chamfer 9 of the rear partition 2 of the support 1. At its upper portion, the rear portion of the auxiliary contact carrier 5 has a ridge 24 adapted to coact with the upper lip 17 of the principal contact carrier 4.

In the rest position, the principal contact carrier 4 bears with its lower surface 14 on the rounded portion of the spring 6, and with its rear surface against the rear partition 2 of the support 1. It is in the rearwardly swung position, its forward surface 11 being slightly oriented upwardly.

The auxiliary contact carrier 5, in its descending movement, is guided at the inlet of the support 1 by the chamfers 9. The role of the chamfers 23, in addition to aiding the insertion into the support 1, is to move the auxiliary contact carrier 5 forwardly, its forward surface 21 entering into contact with the forward partition 3 of the support.

Figure 2:
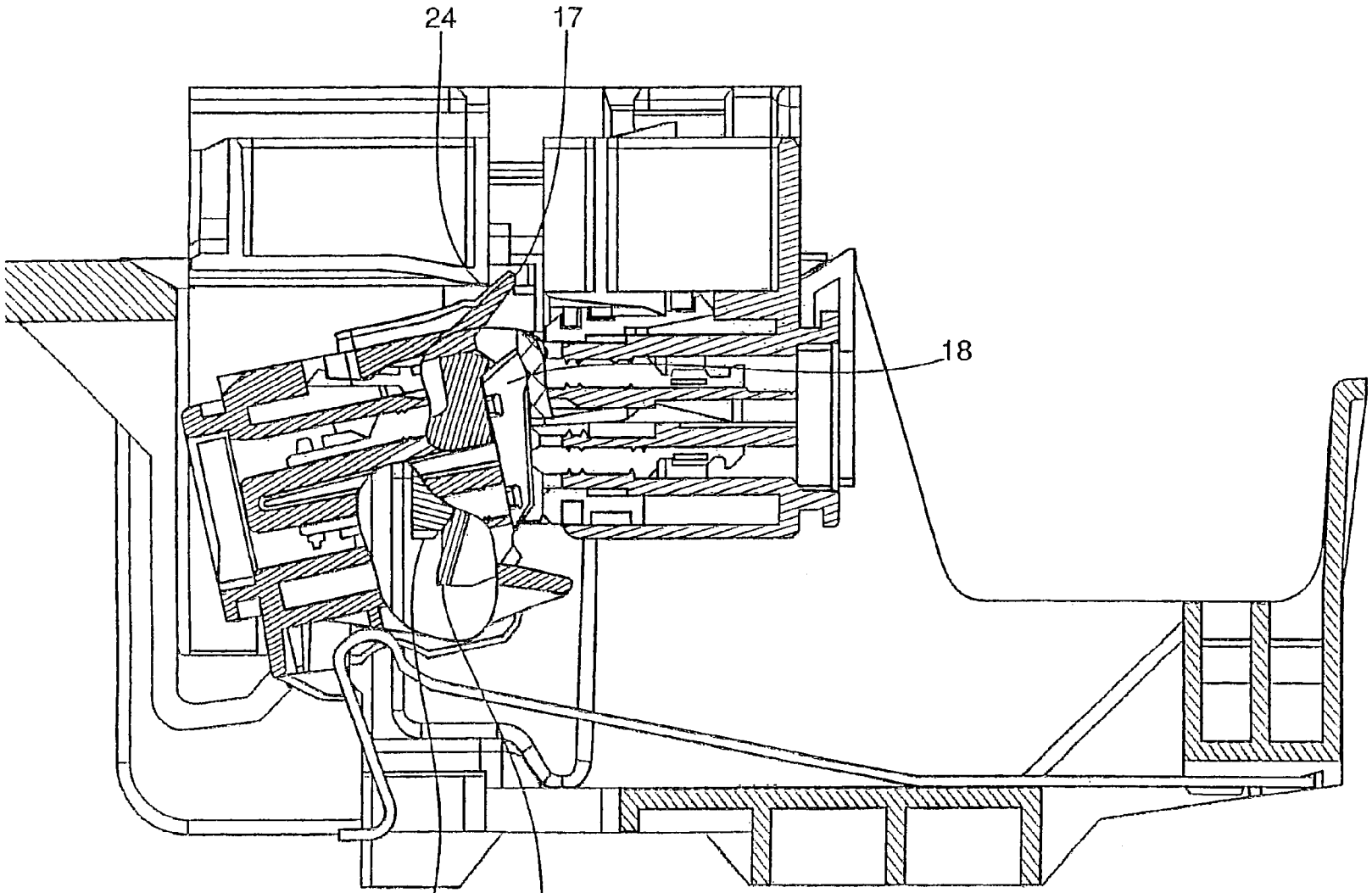
FIG. 2 is a fragmentary axial cross-sectional view of the connection system of FIG. 1 at the time of entry into mechanical contact of the auxiliary contact carrier with the principal contact carrier.

When the descending movement takes place (FIG. 2), the lateral walls of the auxiliary contact carrier 5 are guided by the protuberances 18 of the principal contact carrier 4, which ensures a centering of the auxiliary contact carrier 5 in the median plane of the support 1. Then, the ridge 24 comes into contact with the upper lip 17 of the principal contact carrier 4, and a ramp 25 of the lateral wall 22 of the auxiliary contact carrier 5, comes into contact with the rear profile 26 of the protuberance 18 of the principal contact carrier 4.

Figure 3:
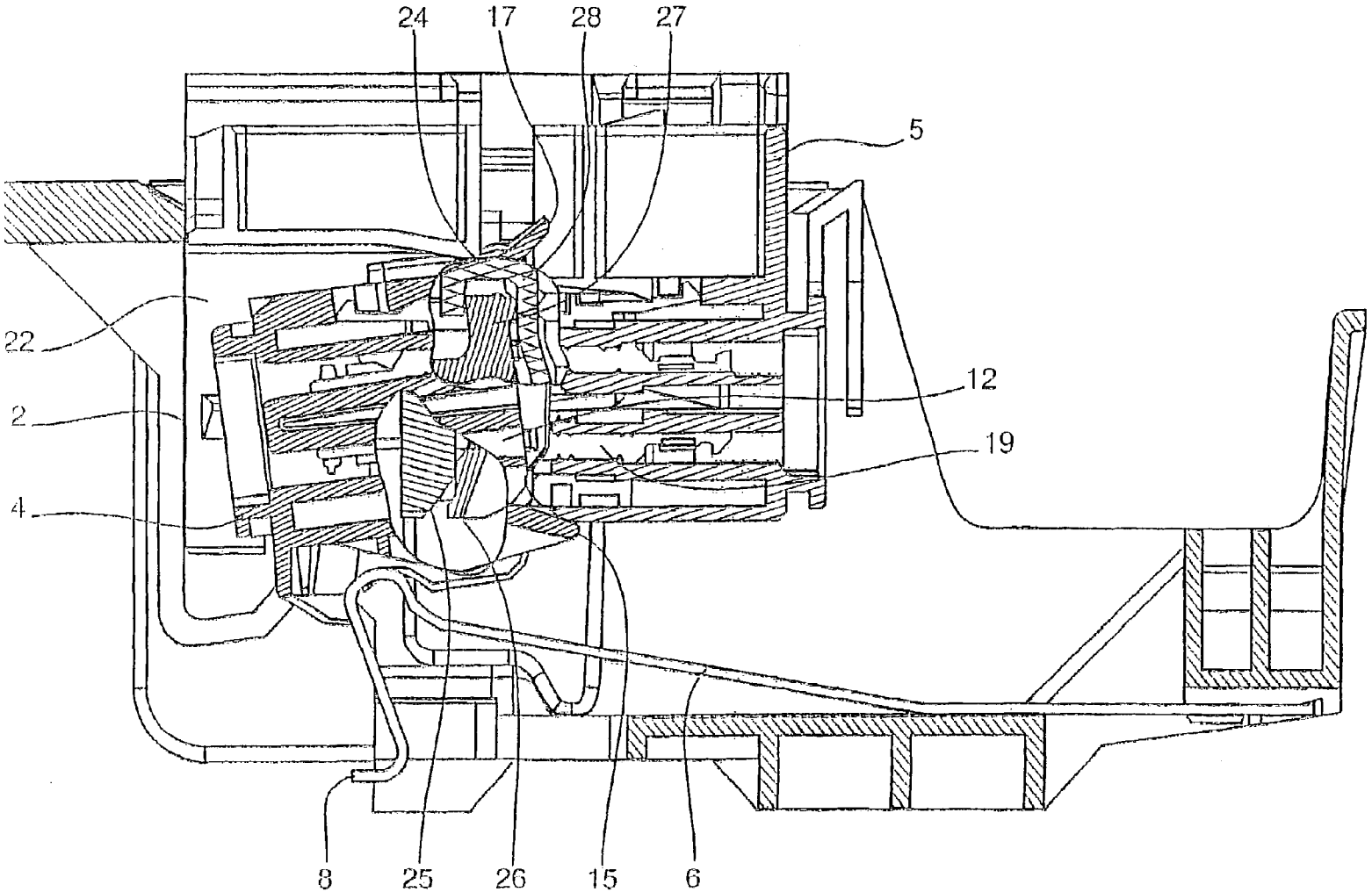
FIG. 3 is a fragmentary axial cross-sectional view of the connection system of FIG. 1 at the time of entry into electrical contact of the contacts of the lower row of the auxiliary and principal contact carriers.

When the descending movement takes place (FIG. 3), on the one hand the lower front portion of the auxiliary contact carrier 5 comes to bear against the lower lip 15, on the other hand the ridge 24 slides on the upper lip 17, which gives rise to forward swinging of the principal contact carrier 4 which pivots on the rounded portion of the spring 6. The ramp 25 slides on the rear profile 26 and causes rearward movement of the auxiliary contact carrier, which retreats until its lateral walls 22 come to bear against the rear partition 2 of the support 1. In the course of this combined movement the electrical contacts of the lower rows 12 and 19 respectively of the principal and auxiliary contact carriers come into contact with each other.

Moreover, in the median portion of the principal and auxiliary contact carriers 4 and 5 there is provided a mechanical connection between a crosspiece 27 of the principal contact carrier and a hook 28 of the auxiliary contact carrier. Finally, the pressure applied to the principal contact carrier 4 is exerted on the spring 6 whose rear end 8 is moved away from bearing relation with the bottom of the support 1.

Figure 4:
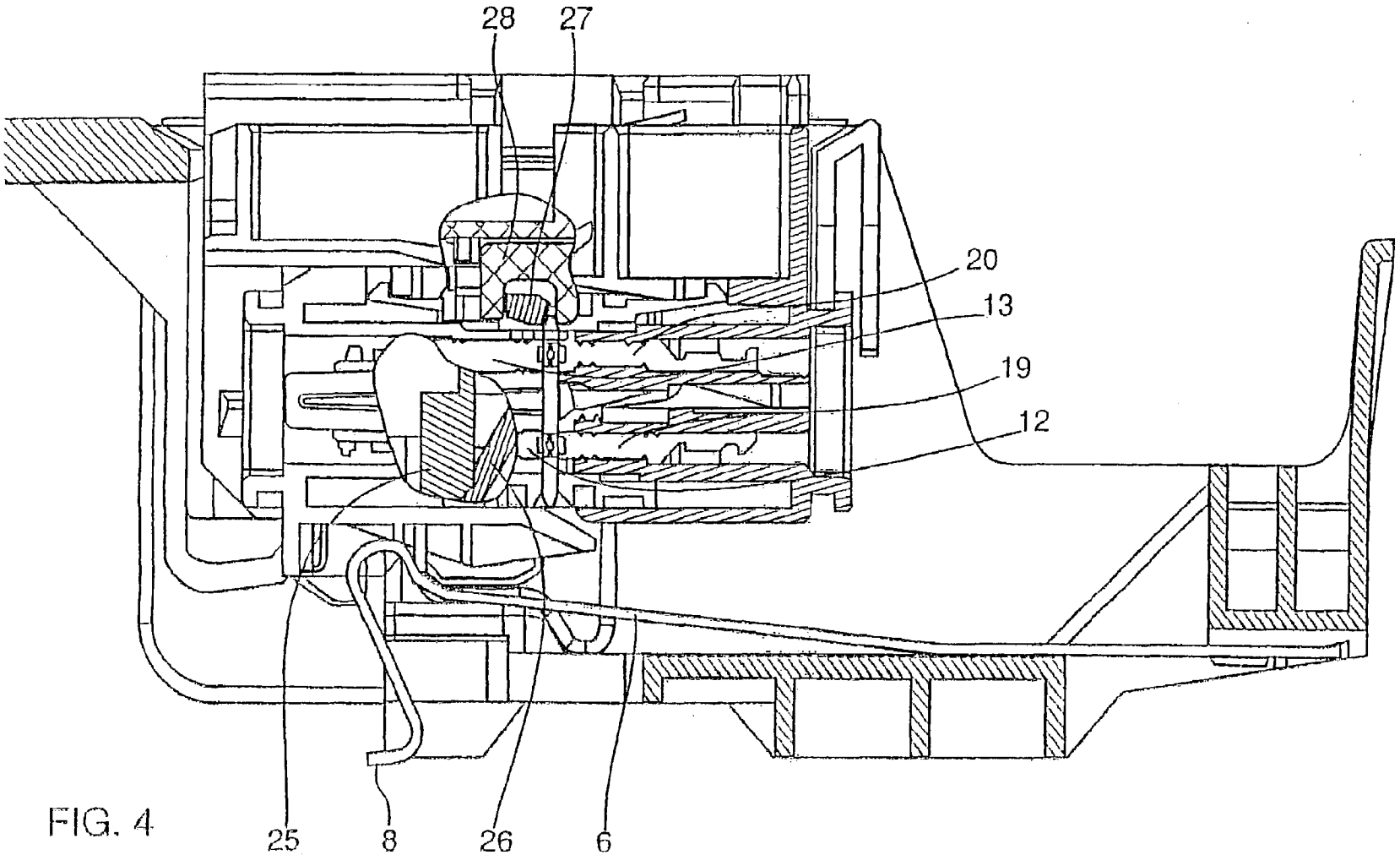
FIG. 4 is a fragmentary axial cross-sectional view of the connection system of FIG. 1 after completion of connection.

When the descending movement is completed (FIG. 4), the pivoting of the principal contact carrier 4 is terminated: its forward surface is substantially vertical; the contacts of the two upper and lower rows 12, 19 and 13, 20 bear against each other respectively; the ramp 25 bears stably against the rear profile 26 of the protuberance 18; the hook 28 is hooked stably to the crosspiece 27; the spring 6 is urged downwardly and its end 8 is substantially separated from the bottom of the support 1; the pressure of the spring 6 upwardly ensures the stable maintenance of the connection between the various electrical contacts. The over-movement of the spring 6 permits taking up the vertical movement at the end of the connection movement.

Figure 5:
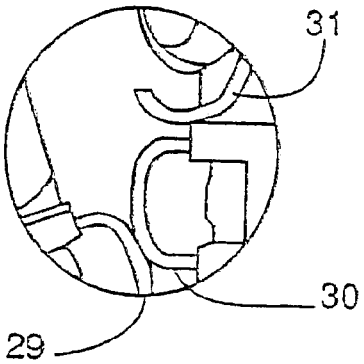
FIG. 5 is an enlarged cross-sectional view of the contacts of FIG. 3.

FIG. 5 is an enlarged view of the electrical contacts of the lower rows 12, 19 at the time of their entry into contact. The principal contact 29 of the lower row 12 and the auxiliary contact 30 of the lower row 19 are vertically offset. An equipotential shunt 31 is shown, in electrical contact with the auxiliary contact 30.

Figure 6:
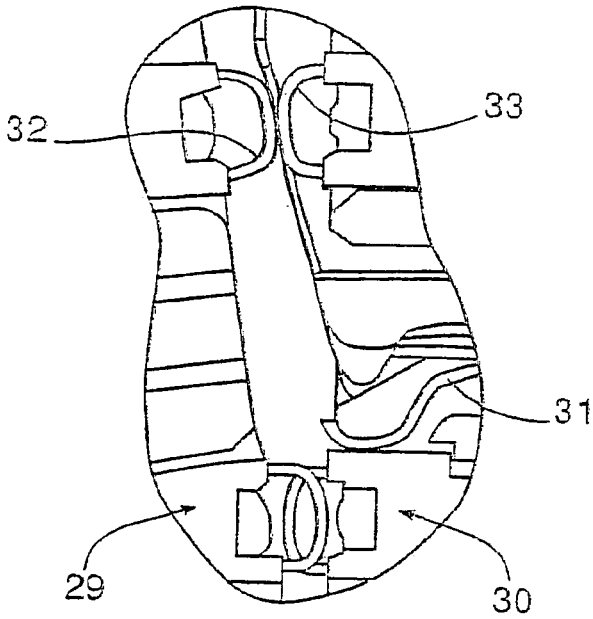
FIG. 6 is an enlarged cross-sectional view of the contacts of the upper row after their entry into contact.

In FIG. 6, the principal and auxiliary contacts 29 and 30 face each other, after relative movement which has the effect of cleaning the electrical contacts. Similarly, the respective contacts 32 and 33 of the upper rows 13 and 20 are in contact.

Figure 7:
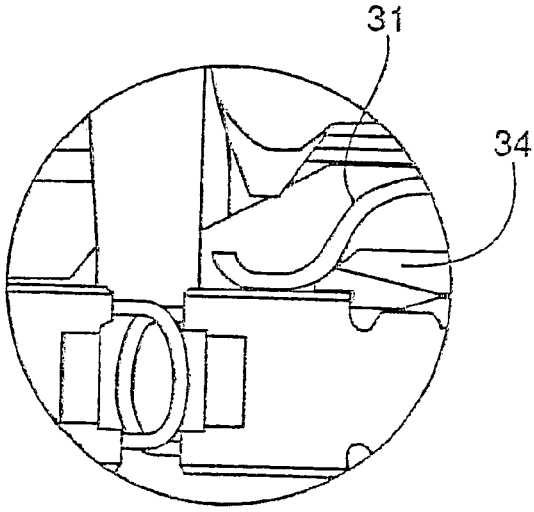
FIG. 7 is an enlarged cross-sectional view of the contacts of FIG. 6 before deshunting.
Figure 8:
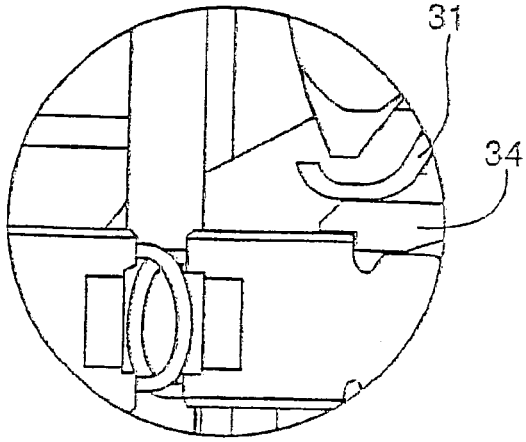
FIG. 8 is an enlarged cross-sectional view of the contacts of FIG. 7 after deshunting, which is to say in the condition of FIG. 4.

In FIG. 7, the shunt 31 begins its retraction forwardly and arrives in abutment against the insulating wall. In FIG. 8, the retracting movement of the shunt 31 is ended, the shunt being insulated from the electrical contacts by the insulating wall 34. This retraction movement of the shunt is ensured by an actuator carried by the auxiliary contact carrier 5 which is pressed by an actuating figure of the principal contact carrier 4. At the end of the connection, the electrical contacts are in compression.

The automatic connection system according to the invention ensures the connection without interaction with the structural elements which support the connection elements.

The auxiliary contact carrier ensures taking up the play in the horizontal plane perpendicular to the connection movement. The principal contact carrier is swingably mounted and serves to guide the auxiliary contact carrier thanks to its projecting elements: upper and lower lips, protuberances with their rear profile.

The support with a single spring permits ensuring the holding in the rest position of the principal contact carrier, and at the end of connection, ensures taking up the play in the vertical direction of the connection movement, and the locking in connected position.

The connection movement combines a descent of the auxiliary contact carrier and a swinging of the principal contact carrier. In the course of this movement, there takes place a cleaning of the electrical contacts.

The actuator ensuring the deshunting is preferably constituted by a drawer moved, at the end of connection, by a finger carried by the principal contact carrier.

This drawer movement can be used to control other functions.

In the course of the connection movement, the principal contact carrier pivots on the rounded portion of the spring, and the spring does not maintain the same position: as a result, the principal contact carrier does not pivot relative to a fixed axis.

Figure 9:
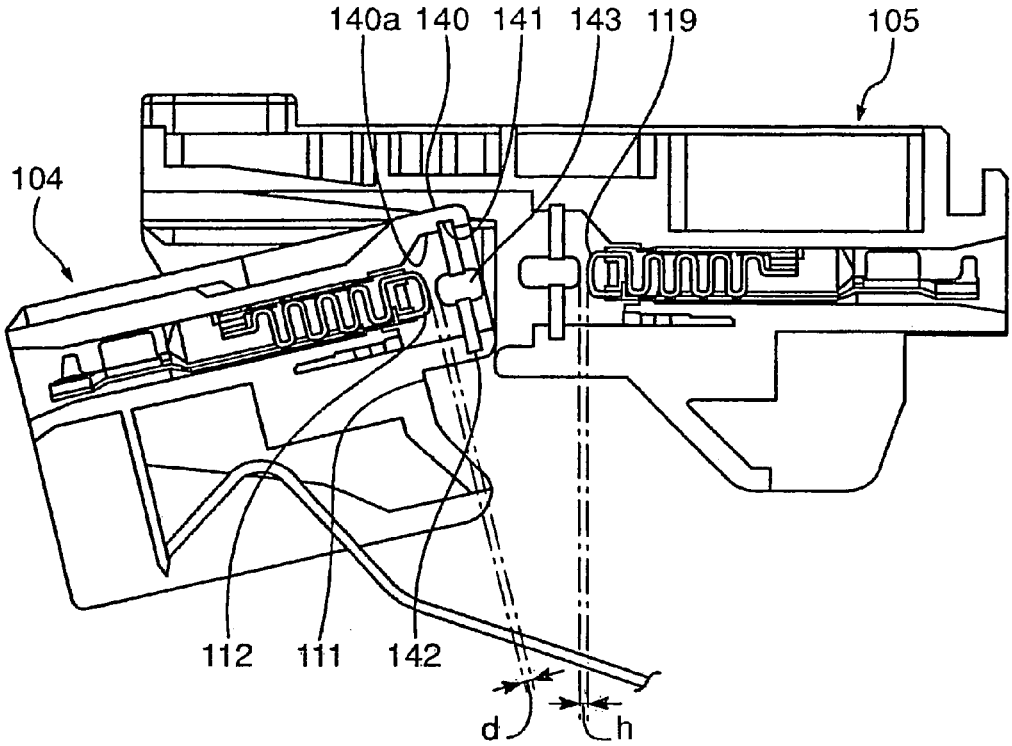
FIG. 9 is a view similar to FIG. 1 showing a second embodiment of the invention.
Figure 10:
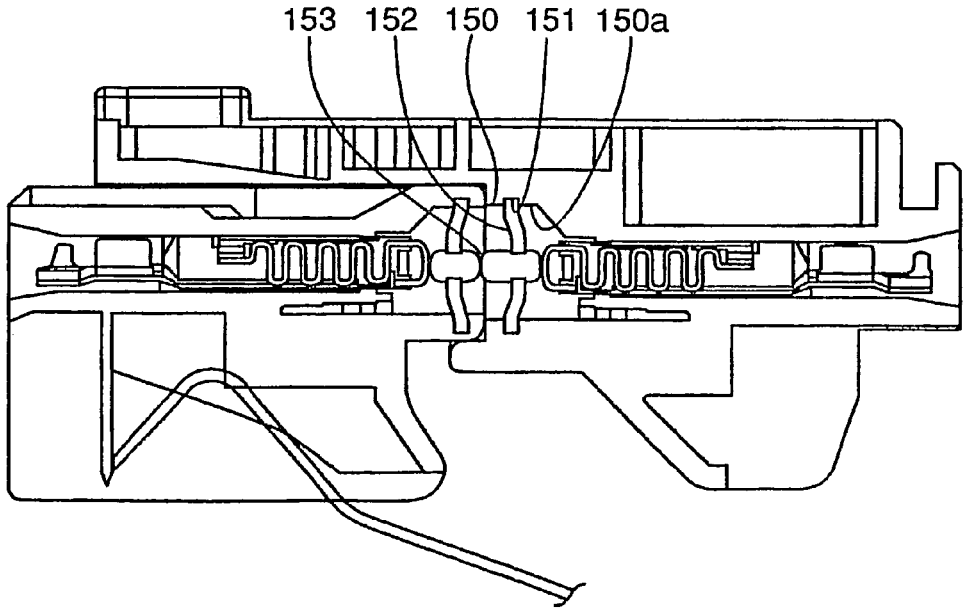
FIG. 10 is a fragmentary axial cross-sectional view of the connection system of FIG. 9 after completion of connection.

Referring to FIGS. 9 and 10, there will now be described a second embodiment. The elements of the connection system identical or similar to the first embodiment are shown by the same reference numeral increased by 100 and are not described again. Here, the contacts of the principal contact carrier 104 are distributed in a single row 112, this number not being limiting. The auxiliary contact carrier 105 also comprises a single row of contacts 119.

The contact carrier 104 comprises on its forward surface 111 a flange 140 surrounding the row 112. The flange 140 comprises on its lower surface 140*a* a peripheral groove 141. A flexible membrane 142, for example of elastomer, is inserted in the groove 141, such that the connection between the groove 141 and the membrane 142 will be sealed. The massive metallic lugs 143, disposed respectively in line with each contact of row 112, pass through the membrane 142 and are fixed to the membrane 142 in a sealed manner. The lugs 143 have for example a substantially cylindrical shape and project on opposite sides of the membrane 142. In the rest position (FIG. 9), the membrane 142 extends in the plane of the groove 141, the contacts of the row 112 and the lugs 143 being separated by a distance d, the distance d being preferably greater than 0.5 mm.

The contact carrier 105 has in a similar manner a flange 150 surrounding the row 119. The flange 150 comprises on its lower surface 150*a* a peripheral groove 151. A flexible member 152, for example of elastomer, is inserted in the groove 151, such that the connection between the groove 151 and the membrane 152 will be sealed. The massive metallic lugs 153, disposed respectively in line with each contact of the row 119, pass through the membrane 152 and are fixed in a sealed manner to the membrane 152. The lugs 153 have for example a substantially cylindrical shape and project on opposite sides of the membrane 152. In the rest position (FIG. 9), the membrane 152 extends in the plane of the groove 151, the contacts of the row 119 and the lugs 153 being separated by a distance h, the distance h being for example equal to the distance d.

In the rest position, the principal contact carrier 104 is in rearwardly swung position, its forward surface 111 slightly upwardly oriented, such as has been previously described. The membranes 142 and 152 are flat and the lugs 143 and 153 are separated from the contacts of the row 112 and the row 119, respectively.

The descending movement is similar to the first embodiment. During this movement, the lugs 143 and 153, which face each other, come into contact.

During the course of the descent, the pressure exerted by the lugs 143 and 153 against each other causes the deformation of the membranes 142, 152. The depth of the flanges 140, 150 and the length of the projecting portions of the lugs 143, 153 are provided so as to permit a sufficient deformation of the membranes 142, 152, such that, when the descent takes place, the lugs 143, 153 will be adapted to come into contact against the contacts of the rows 112, 119 and compress the spring integrated with these contacts.

In the connected position, the contacts of the row 112 are in contact with the lugs 143, the lugs 143 are in contact with the lugs 153 and the lugs 153 are in contact with the contacts of the row 119. The current can thus flow between the contact carrier 104 and the contact carrier 105. This position is shown in FIG. 10.

Thus, the membranes 142, 152 permit protecting the contacts of the rows 112, 119 against any flow, particularly of water, adapted to degrade their mechanical and/or electrical qualities. Moreover, even if the contacts of the rows 112, 119 remain powered when the contact carriers 104, 105 are in rest position, the metallic lugs 143, 153, which are spaced from the contacts by the membranes 142, 152, are not supplied, which increases the safety of the connection system.

The invention claimed is:

1. System for the automatic connection of a principal electrical circuit of a vehicle to an auxiliary electrical circuit of a sub-assembly such as a seat of the vehicle, movable for its securement to a structural element of the vehicle in a substantially vertical assembly direction, said system comprising an auxiliary contact carrier (5), fixed on the sub-assembly, and a principal contact carrier (4) movable on the structural element, between a rest position toward which it is resiliently urged and a connection position toward which it is automatically driven by the auxiliary contact carrier (5) during mounting of the sub-assembly on the structural element of the vehicle, the connection between the principal contact carrier (4) and the auxiliary contact carrier (5) being ensured in a substantially vertical plane, characterized in that: the principal contact carrier (4) is swingably mounted in a support (1) of the structural element, bearing against a spring (6), and comprises projecting members to ensure the guidance of the auxiliary contact carrier (5) in the course of the connection movement.

2. System of automatic connection according to claim 1, characterized in that the projecting members comprise protuberances (18) disposed on the lateral surfaces of the principal contact carrier (4) and adapted to guide the lateral surfaces of the auxiliary contact carrier (5).

3. System of automatic connection according to claim 2, characterized in that the protuberances (18) have a rear profile (26) adapted to coact with a ramp (25) carried by the auxiliary contact carrier (5).

4. System of automatic connection according to claim 1, characterized in that the principal contact carrier (4) has on its forward surface (11) a lower lip (15) adapted to coact with the lower portion of the auxiliary contact carrier (5).

5. System of automatic connection according to claim 4, characterized in that the principal contact carrier (4) carries on its forward surface (11) an upper lip (17) adapted to coact with a ridge (24) of the auxiliary contact carrier (5).

6. System of automatic connection according to claim 1, characterized in that the principal contact carrier (4) has an actuating finger of an actuator carried by the auxiliary contact carrier (5) to ensure the deshunting of the auxiliary contacts at the end of connection.

7. System of automatic connection according to claim 1, characterized in that the spring (6) has one end (7) fixed to the support (1), its other end (8) being free, and is bent in a rounded shape below the principal contact carrier (4).

8. System of automatic connection according to claim 1, characterized in that said principal contact carrier (4) and said auxiliary contact carrier (5) each comprise a protection means (142, 152) covering their respective contact elements (112, 119), each of said protection means comprising a conductive portion (143, 153), each of said protection means being movable between an inactive position in which said conductive portion is not in contact with said corresponding contact elements and an active position in which said conductive portion is in contact with said corresponding contact elements, said protection means being adapted automatically to take said active position when said principal contact carrier is moved to said connection position, said conductive portions of each of said protection means being in contact when said protection means are in said active position.

9. System of automatic connection according to claim 8, characterized in that each of said protection means comprises a flexible membrane (142, 152), said membrane being fixed in a sealed manner to a flange (140, 150) surrounding said contact elements (112, 119), said conductive portion comprising metallic lugs (143, 153) passing through said membrane.

* * * * *